US006412373B1

(12) United States Patent
Hsiao

(10) Patent No.: US 6,412,373 B1
(45) Date of Patent: Jul. 2, 2002

(54) OPERATING TOOL HAVING SHANKS TURNABLE RELATIVE TO ONE ANOTHER

(76) Inventor: Chieh-Jen Hsiao, 2F, No. 215, Yu-Te Rd., Pei Dist., Taichung City (TW)

( * ) Notice: Subject to any disclaimer, the term of this patent is extended or adjusted under 35 U.S.C. 154(b) by 0 days.

(21) Appl. No.: 09/794,971

(22) Filed: Feb. 27, 2001

(51) Int. Cl.[7] ..... B25B 23/16
(52) U.S. Cl. ..... 81/177.7; 81/177.75
(58) Field of Search ..... 81/177.7, 177.8, 81/177.9, 177.6, 177.75

(56) References Cited

U.S. PATENT DOCUMENTS 5,732,606 A * 3/1998 Chiang ..... 81/177.2
6,105,473 A * 8/2000 Huang ..... 51/177.8
6,145,413 A * 11/2000 Lin ..... 81/177.7
6,234,049 B1 * 5/2001 Ju et al. ..... 81/177.7

* cited by examiner

*Primary Examiner*—D. S. Meislin
(74) *Attorney, Agent, or Firm*—Merchant & Gould, P.C.

(57) ABSTRACT

An operating tool includes a plurality of pivotally connected shanks which are turnable relative to one another.

7 Claims, 8 Drawing Sheets

OPERATING TOOL HAVING SHANKS TURNABLE RELATIVE TO ONE ANOTHER

BACKGROUND OF THE INVENTION

1. Field of the Invention

The invention relates to an operating tool, more particularly to an operating tool having a plurality of shanks which are adapted to be retained in axial alignment and at an angle relative to one another.

2. Description of the Related Art

Referring to FIG. 1, a conventional operating tool is shown to include a first shank 1, a second shank 2 of hexagonal cross section, an operating bit 4, a tubular guide sleeve 3, and a retaining device in the form of C-shaped rings 107, 108.

As illustrated, the first shank 1 has a bit-mounting end defining an axially extending bit-retention bore 101 therein, and a connecting end that is opposite to the bit-mounting end and that is formed with a hexagonal hole 102. A magnet 103 is fixed in the bit-retention bore 101 of the first shank 1 in order to prevent untimely removal of the operating bit 4 when the latter is mounted in the bit-retaining bore 101. A front end of the second shank 2 is inserted into the hexagonal hole 102 of the first shank 1. The guide sleeve 3 is slidably disposed on the first shank 1, and has an annular recess 302 formed in an inner wall surface 301 thereof. The C-shaped rings 107, 108 are mounted in annular grooves 105, 106 formed in the bit-mounting end and the connecting end of the first shank 1, and are engageable selectively with the recess 302 when the guide sleeve 3 slides thereon so as to prevent axial disengagement therebetween.

As best shown in FIG. 2, when tightening a screw into a wall, the rear end of the second shank 2 is connected to an electrically-operated drill 5. The operating bit 4 is attached to the headed end of the screw, and the whole assembly is held in a straight line. Then, the guide sleeve 3 is moved toward the wall in order to guide the screw such that the latter will be fixed in the wall upon actuation of the drill 5.

Since the second shank 2 can not be retained at an angle relative to the first shank 1, the utility of the conventional operating tool is severely limited.

SUMMARY OF THE INVENTION

Therefore, the object of this invention is to provide an operating tool having a plurality of shanks which are capable of being disposed in axial alignment with and at an angle relative to one another so as to overcome the aforementioned drawback that is generally associated with the conventional operating tool.

Accordingly, an operating tool of the present invention includes an elongated first shank, an operating bit, a linkage shank, a first pivot, a first retaining device, a second shank, a second pivot, a second retaining device, a guide sleeve, and a third retaining device. The first shank has a bit-mounting end defining an axially extending bit-retaining bore therein and a pivot end opposite to the bit-mounting end. The operating bit is mounted detachably in the bit-retaining bore of the first shank. The linkage shank has opposite front and rear sections. The first pivot extends through the front section of the linkage shank and the pivot end of the first shank to permit a pivotal action of the linkage shank about the first pivot with respect to the first shank. The first retaining device retains the linkage shank in axial alignment with the first shank and at a first angle relative to the first shank. The second shank has a rear end and a pivot end. The second pivot extends through the pivot end of the second shank and the rear section of the linkage shank to permit a pivotal action of the linkage shank about the second pivot with respect to the second shank. The second retaining device retains the linkage shank in axial alignment with the second shank and at a second angle relative to the second shank. The guide sleeve is mounted slidably on the first shank and is movable thereon so as to enclose an entire length of the linkage shank and the pivot ends of the first and second shanks when the first, linkage and second shanks are axially aligned. The third retaining device prevents axial removal of the sleeve from the first, linkage and second shanks.

The operating tool of the present invention can be applied at a worksite that has an obstruction nearby, which hinders smooth rotation of the operating tool. Under such a condition, the linkage shank can be pivoted to the aforesaid angles relative to the first and second shanks so as to avoid the hindrance caused by the obstruction.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENTS

Figure 1:
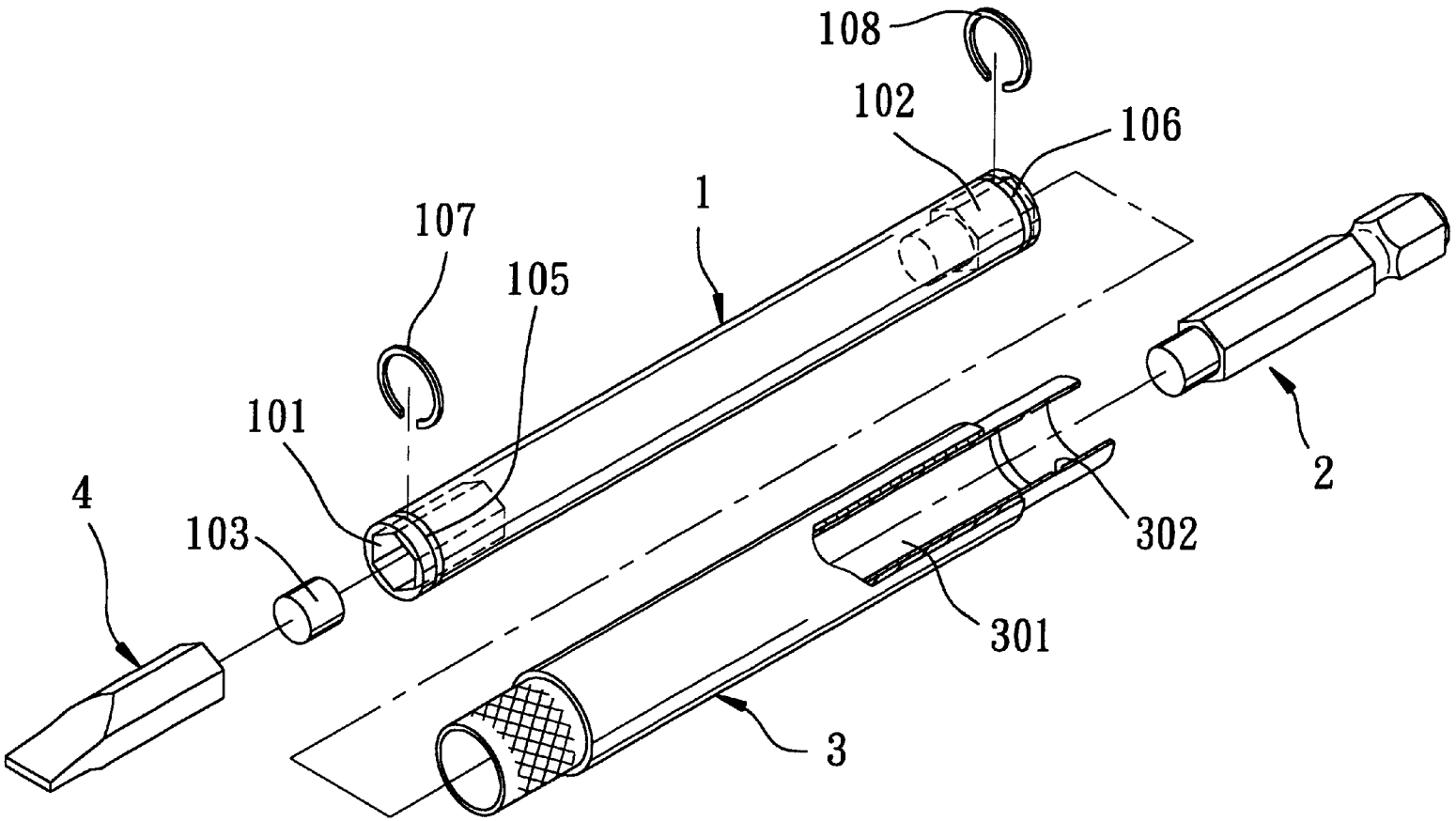
FIG. 1 PRIOR ART
FIG. 1 is an exploded view of a conventional operating tool.
Figure 2:
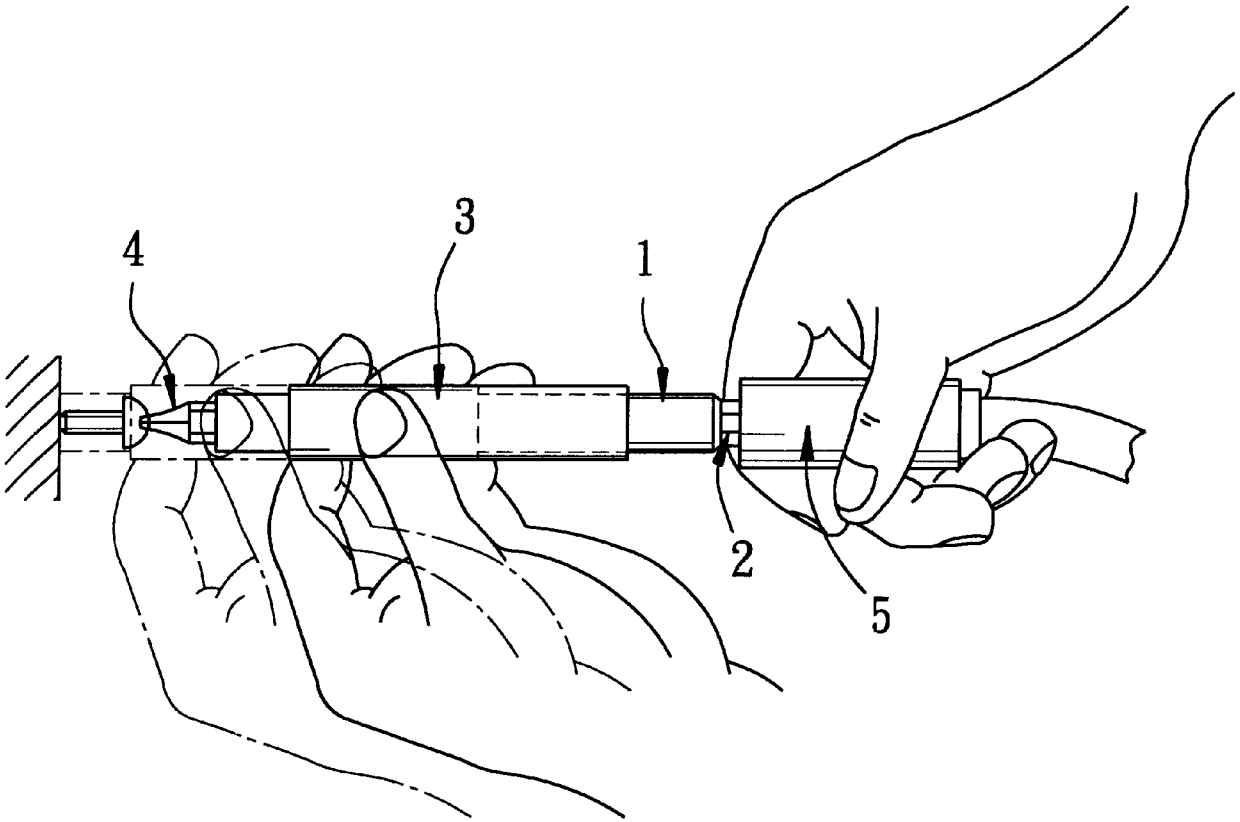
FIG. 2 PRIOR ART
FIG. 2 illustrates how a screw is tightened into a wall by the use of the conventional operating tool.
Figure 3:
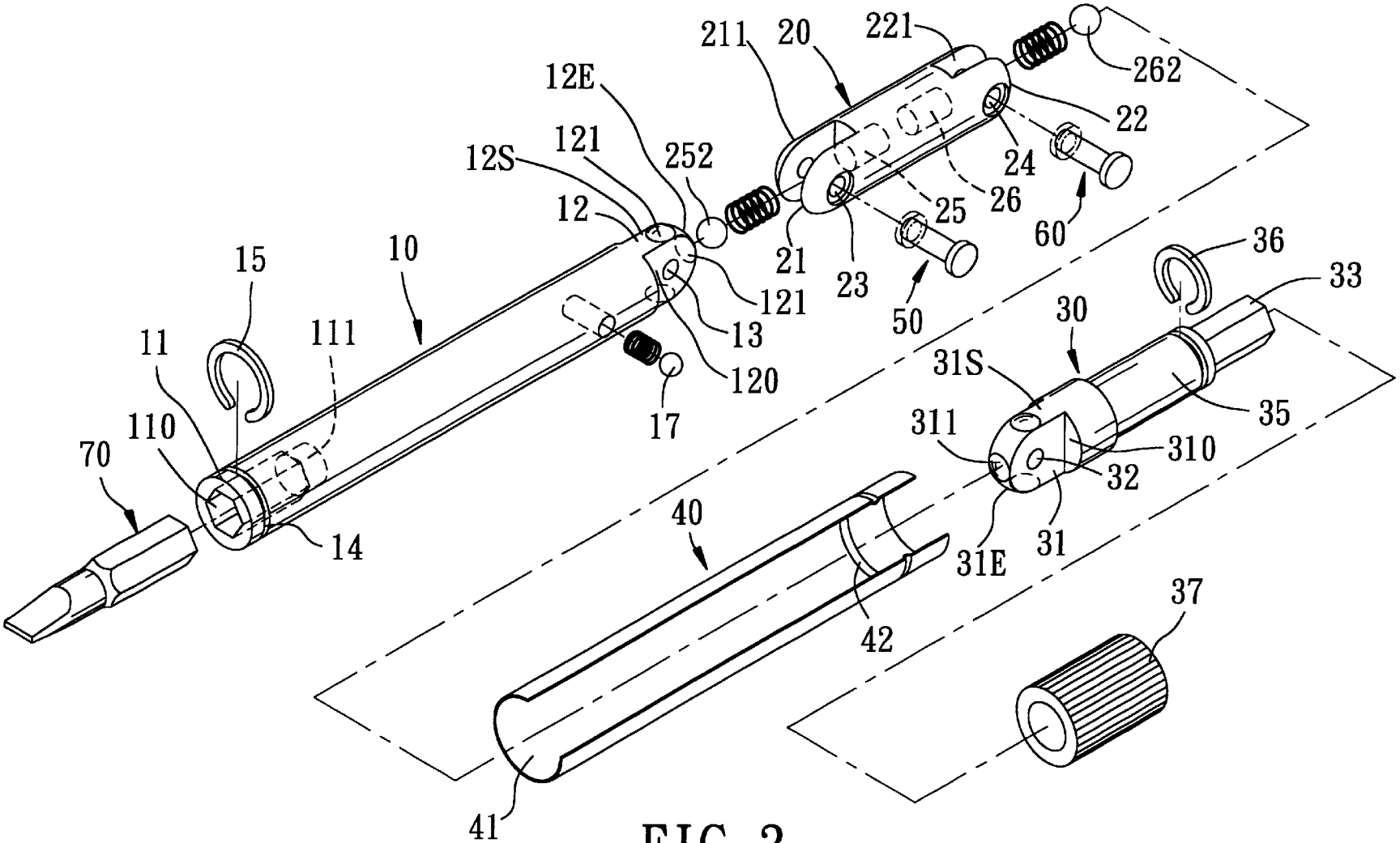
FIG. 3 is an exploded view of a first preferred embodiment of an operating tool according to the present invention.
Figure 4:
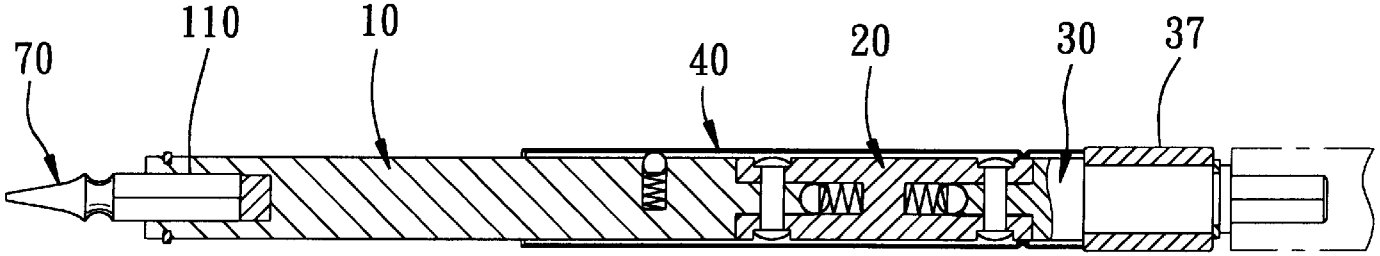
FIG. 4 is a sectional view of the first preferred embodiment, illustrating axial alignment of first, linkage and second shanks of the operating tool of FIG. 2.
Figure 5:
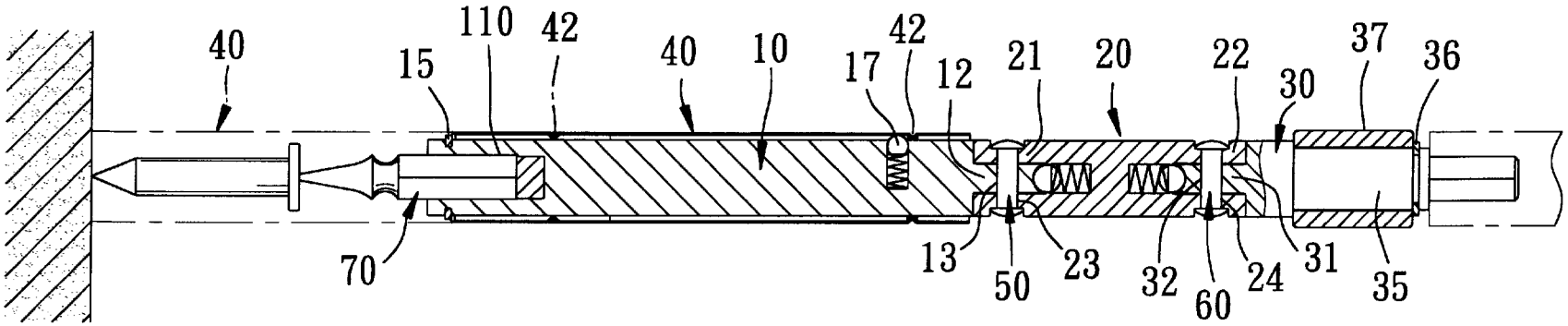
FIG. 5 is a sectional view illustrating how a screw is tightened into a wall by the use of the first preferred embodiment.

Referring to FIGS. 3, 4 and 5, the first preferred embodiment of an operating tool of the present invention is shown to include an elongated first shank 10, an operating bit 70, a linkage shank 20, a first pivot 50, a first retaining device, a second shank 30, a second pivot 60, a second retaining device, a guide sleeve 40, and a third retaining device.

As illustrated, the first shank 10 has a bit-mounting end 11 defining an axially extending bit-retention bore 110 therein, and a pivot end 12 opposite to the bit-mounting end 11.

The operating bit 70 is mounted in the bit-retention bore 110 of the first shank 10, and is prevented from untimely removal therefrom by virtue of a magnet 111 that is fixed to the bottom of the bit-retention bore 110.

The linkage shank 20 has opposite front and rear sections 21,22.

The first pivot 50 extends through two aligned holes 23 in the front section 21 of the linkage shank 20 and a hole 13 in the pivot end 12 of the first shank 10 to permit a pivotal action of the linkage shank 20 about the first pivot 50 with respect to the first shank 10.

Figure 7:
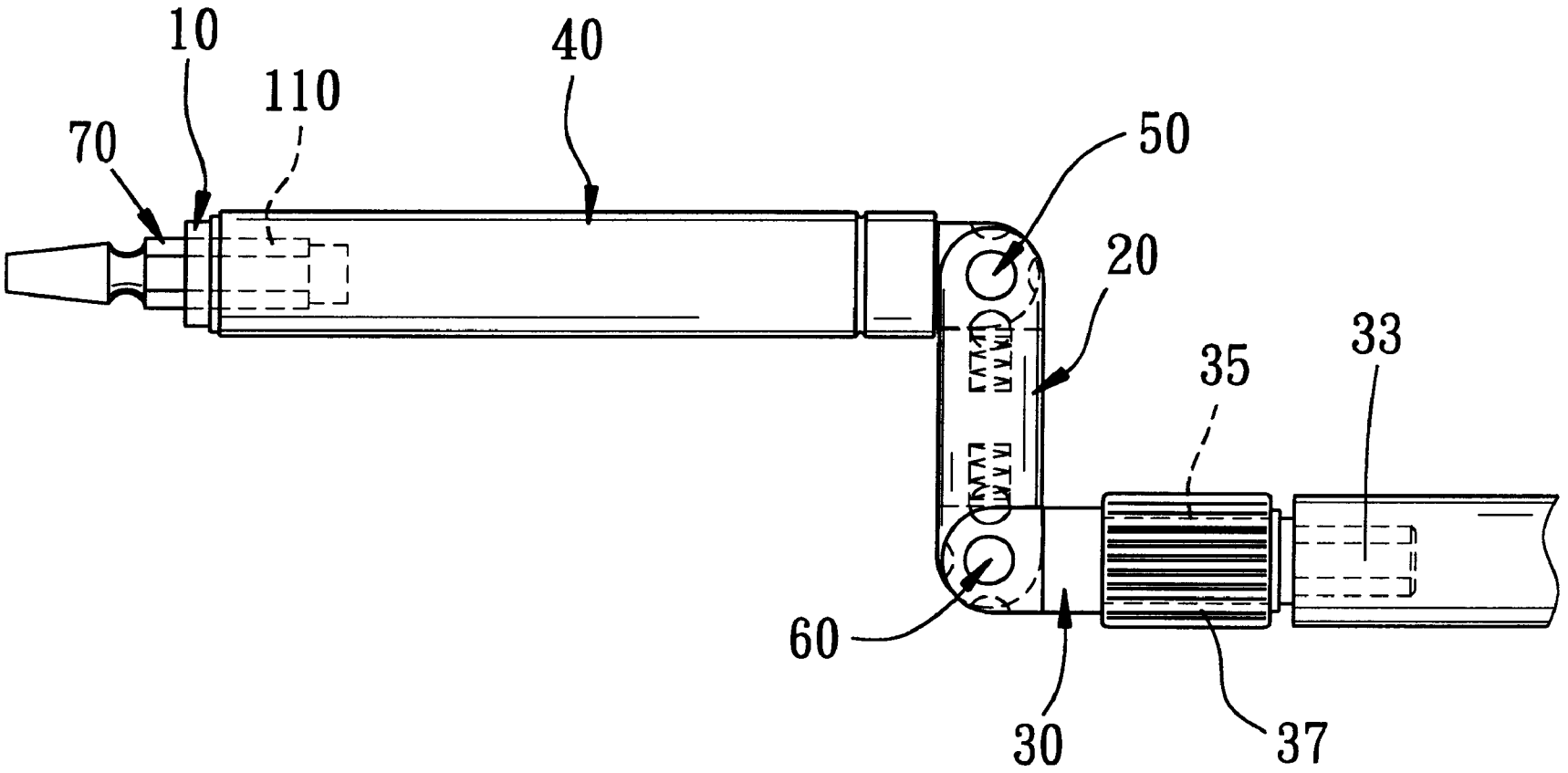
FIG. 7 shows how the first and second shanks are pivoted relative to the linkage shank in the first preferred embodiment in order to perform screw tightening action in a second different mode from that of FIG. 5.

The first retaining device retains the linkage shank 20 in axial alignment with the first shank 10 (see FIG. 4), and at a first right angle relative to the first shank 10, as best shown in FIG. 7.

The second shank 30 has a hexagonal rear end 33 and a front pivot end 31.

The second pivot 60 extends through a hole 32 in the pivot end 31 of the second shank 30, and two aligned holes 24 in the rear section 22 of the linkage shank 20 to permit a pivotal action of the linkage shank 20 about the second pivot 60 with respect to the second shank 30.

Figure 6:
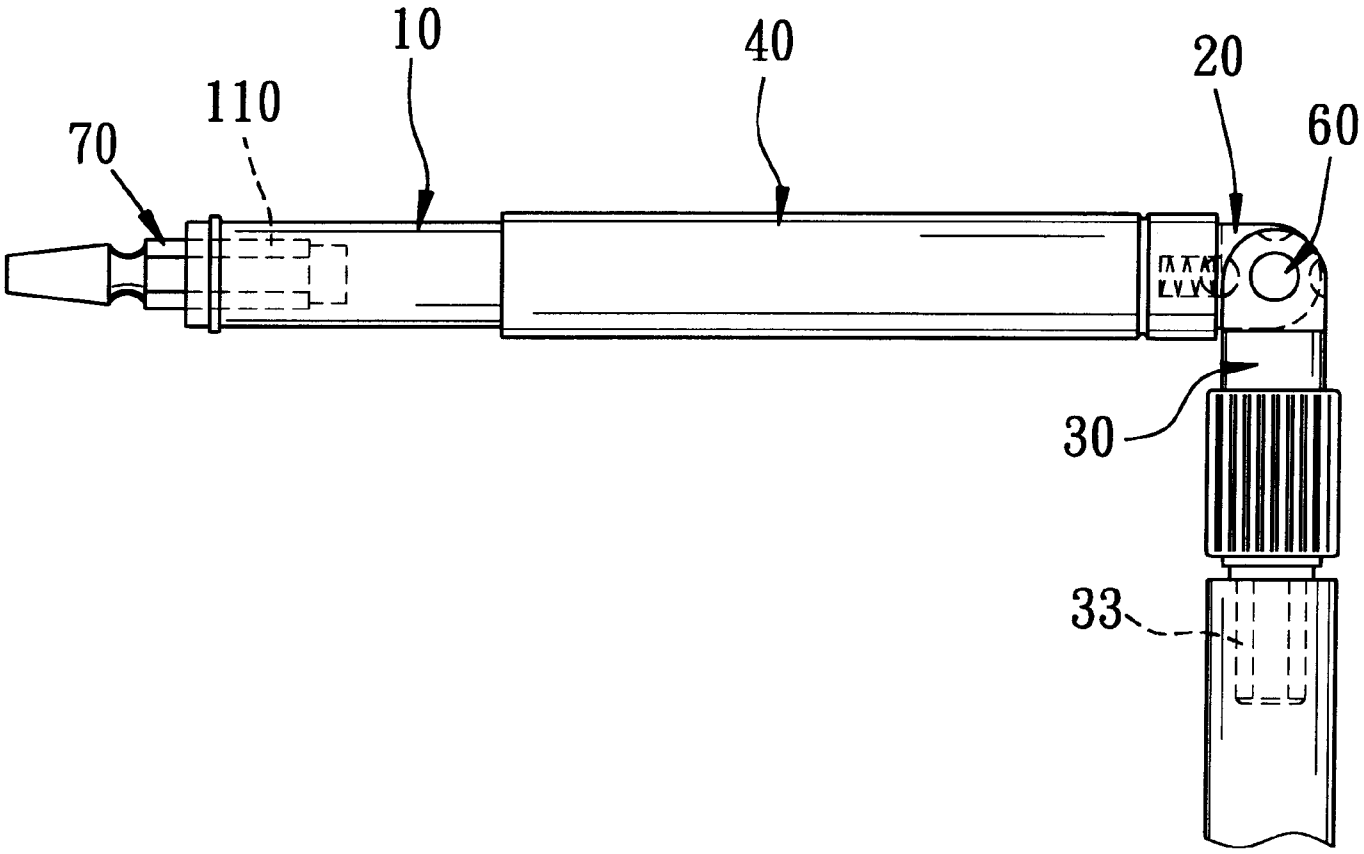
FIG. 6 shows how the first shank is pivoted relative to the linkage shank in the first preferred embodiment in order to perform screw tightening action in a first different mode from that of FIG. 5.

The second retaining device retains the linkage shank 20 in axial alignment with the second shank 30 (see FIG. 4), and at a second right angle relative to the second shank 30, as best shown in FIG. 6.

The guide sleeve 40 is mounted slidably on the first shank 10, and has a sufficient axial length greater than that of the linkage shank 20 such that front and rear portions of the guide sleeve 40 enclose the pivot ends 12, 31, of the first and second shanks 10, 30 when the first, linkage and second shanks 10, 20, 30 are axially aligned, as best shown in FIG. 4. Under such a condition, the guide sleeve 40 prevents twisting of the linkage shank 20 and the second shank 30 relative to the first shank 10. A spring-biased ball 17 is disposed between the first shank 10 and the guide sleeve 40 in order to provide frictional engagement between the two. Preferably, the guide sleeve 40 has an inner wall surface 41, and a stop flange 42 which projects radially and inwardly from the inner wall surface 41.

The front and rear sections 21, 22 of the linkage shank 20 define a pair of spaced apart front ears 211 and a pair of spaced apart rear ears 221 respectively straddling on two opposite sides of the pivot ends 12, 31 of the first and second shanks 10,30. The first and second pivots 50, 60 extend through the front and rear ears 211,221.

The first and second shanks 10, 30 have cylindrical sections. Each of the pivot ends 12, 31 of the first and second shanks 10, 30 extends axially from the respective cylindrical section, is reduced therefrom, and has a curved end face (12E 31E), and two opposite side faces (12S, 31S) which extend in axial directions relative to the respective one of the first and second shanks 10, 30 from two opposite ends of the curved end face (12E 31E). Each of the curved end face (12E 31E) and the side faces (12S, 31S) is formed with a ball-retention recess (121,311) in such a manner that the ball-retention recess (121,311) in the curved end face (12E 31E) is aligned with a center line of a respective one of the first and second shanks 10, 30.

Each of the first and second retaining device includes a spring-biased ball (252,262) mounted on a respective one of the front and rear sections 21,22 of the linkage shank 20 in such a manner that the spring-biased ball (252,262) is selectively received in the ball-retention recess (121,311) in the curved end face (12E,31E) and the side faces (12S,31S) of the pivot end (12, 31) of a respective one of the first and second shanks 10, 30. Under such a condition, the spring-biased ball (252,262) is received in the ball-retention recess (121, 311) in the curved end face (12E, 31E) when the first, linkage and second shanks (10,20,30) are axially aligned with one another. When the linkage shank 20 is disposed at the first and second right angles relative to the first and second shanks (10,30), the spring-biased ball 252 is received in the ball-retention recess (121,311) in one of the side faces (12S, 31S), as best shown in FIG. 7. The operating tool of the present invention can be driven by a machine. Preferably, each of the front and rear sections 21, 22 of the linkage shank 20 defines a ball-retention bore (25,26) that is formed between a respective pair of the spaced apart ears (211,221) and that receives the spring-biased ball 252 therein. Each of the first and second shanks 10, 30 further has a pair of stop shoulders (120,310) formed on the opposite side faces (12S,31S) of the pivot end (12,31) thereof. The stop shoulders (120,310) abut against the front and rear ears (211,221) of the linkage shank 20 when the latter is disposed at the first and second right angles with respect to the first and second shanks 10, 30 so as to enhance retention of the linkage shank 20 at the first and second right angles.

The third retaining device includes a rear stop tube 37 mounted on a middle portion 35 of the second shank 30 by the use of a C-shaped retainer ring 36, and capable of abutting against the rear end of the guide sleeve 40 to prevent further rearward movement of the guide sleeve 40 on the second shank 30, and a resilient C-shaped stop ring 15 that is sleeved in an annular groove 14 formed in the bit-mounting end 11 of the first shank 10 for abutting against the stop flange 42 of the guide sleeve 40 to prevent axial removal of the guide sleeve 40 from the first shank 10 when the guide sleeve 40 moves forward on the first shank 10.

As shown in FIG. 5, for guiding axial alignment of the screw relative to the operating bit 70, the guide sleeve 40 can be moved toward the wall prior to actuation of the second shank 30 by a machine.

Referring to FIG. 6, in case the second shank 30 is disposed at the right angle relative to the linkage shank 20, the operating tool of the present invention can serve as an L-shaped tool. In order to rotate the operating bit 70, the user can manually turn the second shank 30 with one hand while the other hand grips the guide sleeve 40 so as to retain the first shank 10 therein.

Figure 8:
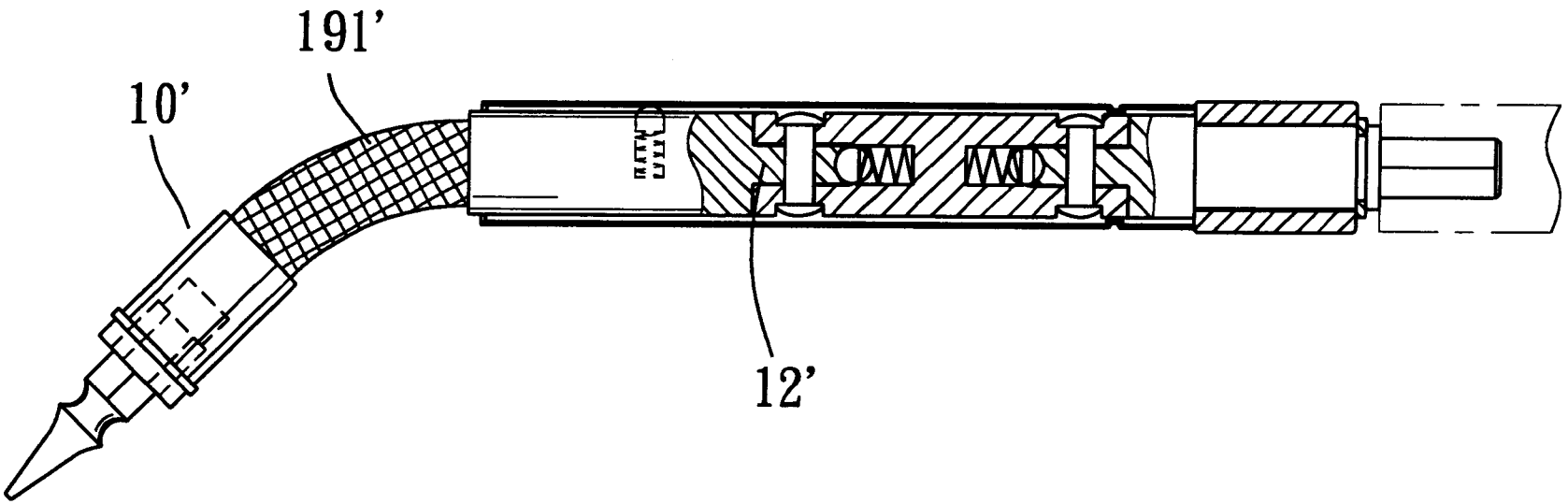
FIG. 8 is a fragmentary partly sectional view of a second preferred embodiment of the present invention.

Referring to FIG. 8, a second preferred embodiment of the present invention is shown to have a structure similar to that of the first preferred embodiment. The only difference resides in that a connecting tube 191' is interposed between the bit-mounting end 11' and the pivot end 12' of the first shank 10'. The connecting tube 191' is bendable so as to form an angle between the pivot end 12' and the bit-mounting end 11' of the first shank 10'.

Figure 9:
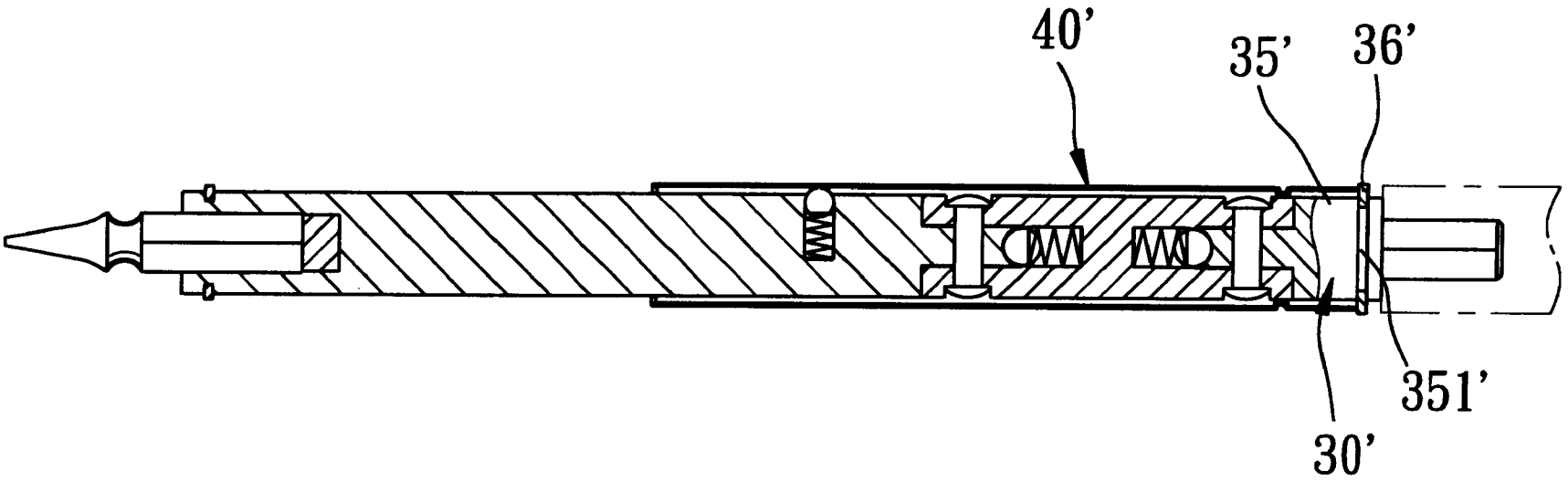
FIG. 9 is a fragmentary partly sectional view of a third preferred embodiment of the present invention.

Referring to FIG. 9, a third preferred embodiment of the present invention is shown to have a structure similar to that of the first preferred embodiment. The only difference resides in that a C-shaped retainer ring 36' is employed instead of the stop tube 37 (see FIG. 3). The retainer ring 37' is fixed in the annular groove 351' formed in the intermediate section 35' of the second shank 30', and has an outer periphery that is exposed to the groove 351' and that abuts against the rear end of the guide sleeve 40' when the latter moves rearward on the second shank 30', thereby preventing axial removal of the guide sleeve 40' from the second shank 30'.

With this invention thus explained, it is apparent that numerous modifications and variations can be made without departing from the scope and spirit of this invention. It is therefore intended that this invention be limited only as indicated in the appended claims.

I claim:

1. An operating tool comprising:

an elongated first shank having a bit-mounting end defining an axially extending bit-retaining bore therein, and a pivot end opposite to said bit-mounting end;

an operating bit mounted detachably in said bit-retaining bore of said first shank;

a linkage shank having opposite front and rear sections;

a first pivot extending through said front section of said linkage shank and said pivot end of said first shank to permit a pivotal action of said linkage shank about said first pivot with respect to said first shank;

a second shank having a rear end and a pivot end;

a second pivot extending through said pivot end of said second shank and said rear section of said linkage shank to permit a pivotal action of said linkage shank about said second pivot with respect to said second shank;

a guide sleeve mounted slidably on said first shank and movable thereon so as to enclose an entire length of said linkage shank and said pivot ends of said first and second shanks when said first, linkage and second shanks are axially aligned; and a third retaining device for preventing axial removal of said sleeve from said first, linkage and second shanks; wherein said guide sleeve has an inner wall surface formed with a stop flange which projects radially and inwardly from said inner wall surface, said third retaining device including a rear stop tube mounted on said rear end of said second shank and capable of abutting against said rear portion of said guide sleeve to prevent further rearward movement of said guide sleeve on said second shank, and a resilient C-shaped stop ring mounted on said bit-mounting end of said first shank for abutting against said stop flange of said guide sleeve to prevent axial removal of said guide sleeve from said first shank when said guide sleeve moves forward on said first shank.

2. The operating tool as defined in claim 1, further comprising:

a first retaining device for retaining said linkage shank in axial alignment with said first shank and at a first angle relative to said first shank; and a second retaining device for retaining said linkage shank in axial alignment with said second shank and at a second angle relative to said second shank.

3. The operating tool as defined in claim 2, wherein said front and rear sections of said linkage shank define a pair of spaced apart front ears and a pair of spaced apart rear ears respectively straddling on two opposite sides of said pivot ends of said first and second shanks, said first and second pivots extending through said front and rear ears.

4. The operating tool as defined in claim 3, wherein each of said first and second shanks has a cylindrical section, each of said pivot ends extending and being reduced from said cylindrical section, and having a curved end face and two opposite side faces extending in axial directions relative to a respective one said first and second shanks from two opposite ends of said curved end face, each of said curved end face and said side faces being formed with a ball-retention recess, said ball-retention recess in said curved end face being aligned with a center line of the respective one of said first and second shanks, each of said first and second retaining device including a spring-biased ball mounted in a respective one of said front and rear sections of said linkage shank in such a manner that said spring-biased ball is selectively received in said ball-retention recess in one of said curved end face and said side faces of said pivot end of a respective one of said first and second shanks, whereby, said spring-biased balls of said first and second retaining devices are received in said ball-retention recesses in said curved end faces when said first, linkage and second shanks are axially aligned with one another, and that said spring-biased balls are received in said ball-retention recesses in said side faces when said linkage shank is disposed at said first and second angles relative to said first and second shanks.

5. The operating tool as defined in claim 4, wherein each of said front and rear sections of said linkage shank defines a ball-retention bore that is formed between a respective pair of said spaced apart ears and that receives said spring-biased ball therein.

6. The operating tool as defined in claim 4, wherein each of said first and second shanks further has a pair of stop shoulders formed on said opposite side faces of said pivot end thereof, said stop shoulders being capable of abutting against said front and rear ears of said linkage shank when said linkage shank is disposed at said first and second angles with respect to said first and second shanks so as to enhance retention of said linkage shank at said first and second angles.

7. The operating tool as defined in claim 1, wherein said first shank further includes a connecting tube interposed between said bit-mounting end and said pivot end thereof, said connecting tube being bendable so as to form an angle between said pivot end and said bit mounting end of said first shank.

* * * * *